United States Patent [19]

Greenhut et al.

[11] 4,358,056

[45] Nov. 9, 1982

[54] SHOWER DISPENSER

[75] Inventors: Bart E. Greenhut, Santa Monica; Oded Saphir, Los Angeles, both of Calif.

[73] Assignee: Emmett Laboratories, Inc., Santa Monica, Calif.

[21] Appl. No.: 108,130

[22] Filed: Dec. 28, 1979

[51] Int. Cl.[3] ..... B05B 7/30

[52] U.S. Cl. ..... 239/305; 222/162; 222/454; 239/318

[58] Field of Search ..... 239/302-305, 239/318; 222/162, 166, 167, 192, 168, 454, 455

[56] References Cited

U.S. PATENT DOCUMENTS

| | | | |
|---|---|---|---|
| 1,171,318 | 2/1916 | Carling | 222/166 |
| 1,654,810 | 1/1928 | Hillyard | 222/166 |
| 2,042,455 | 6/1936 | Barrott | 222/166 |
| 3,446,438 | 5/1969 | Watson | 239/318 |
| 3,486,695 | 12/1969 | Novak | 239/318 |
| 4,218,013 | 8/1980 | Davison | 239/318 |

*Primary Examiner*—Robert B. Reeves

*Assistant Examiner*—Michael J. Forman

*Attorney, Agent, or Firm*—Freilich, Hornbaker, Wasserman, Rosen & Fernandez

[57] ABSTRACT

An apparatus for mixing a bathing liquid into shower water, of a type that includes a reservoir assembly for holding the liquid and a mixer coupling connected between a water outlet and shower head to mix bathing oil from the reservoir with water flowing towards the shower head. The reservoir assembly includes a reservoir that can hold a small quantity of bathing liquid, a container which can hold more than the reservoir to repeatedly fill it, and a housing that pivotally supports the container to flow bathing liquid into the reservoir until the liquid reaches the level of the opening in the container. The mixer coupling includes a venturi to pass shower water and draw in bathing liquid, a chamber between the venturi inlet and the shower water entrance, an air vent leading to the chamber, and a diaphragm freely movable in the chamber against and away from the air vent to permit the outflow of liquid from the coupling when the shower is turned off.

5 Claims, 17 Drawing Figures

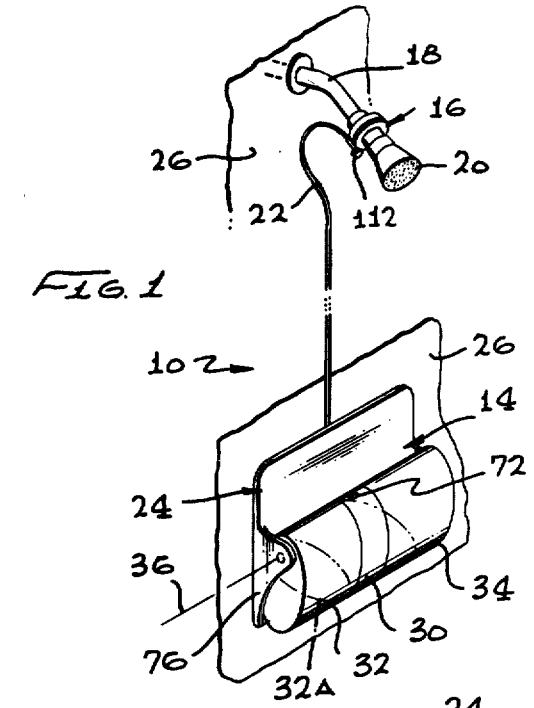
FIG. 1
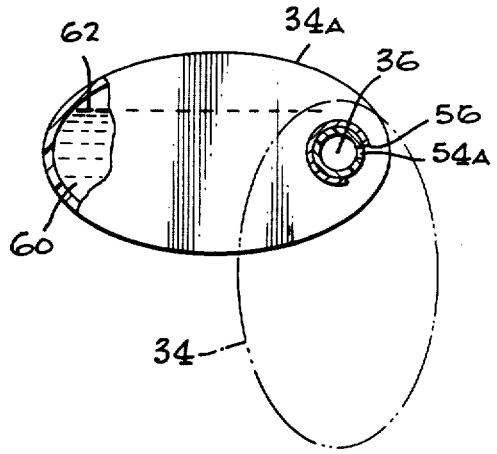
FIG. 4
FIG. 2
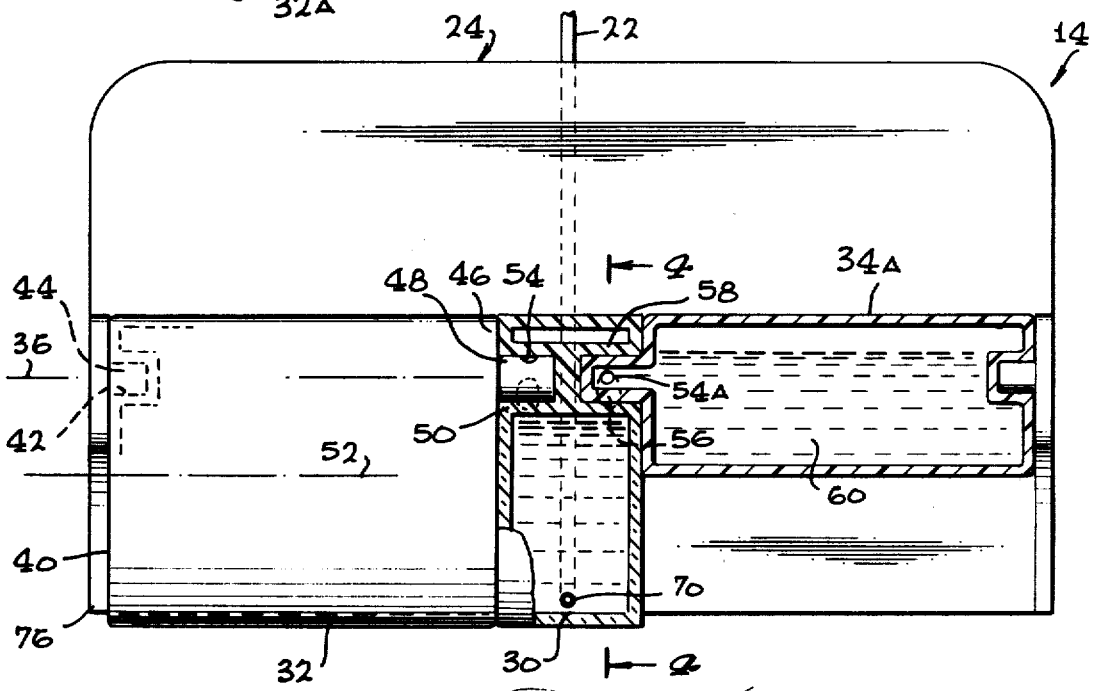
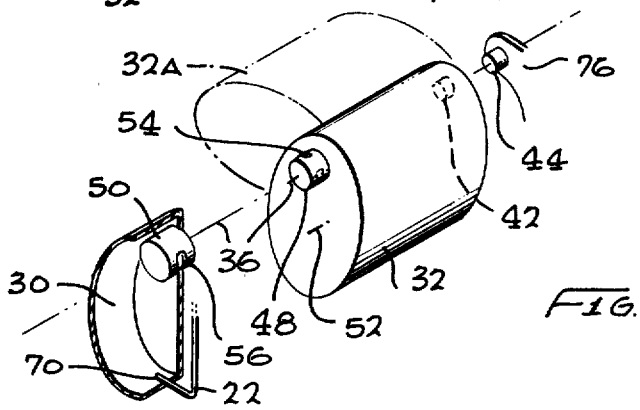
FIG. 3

FIG. 5
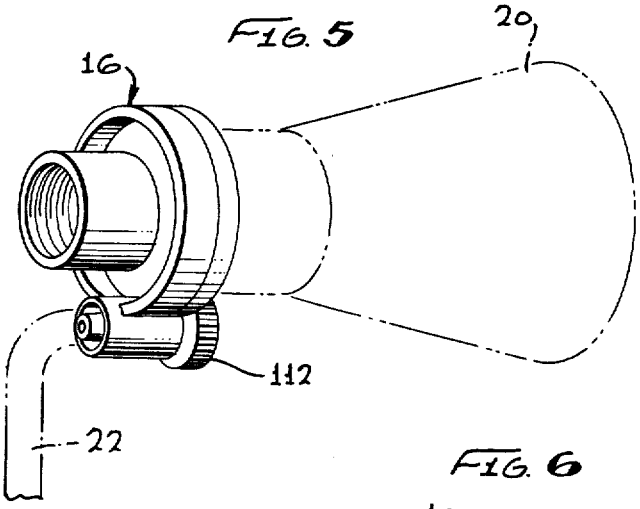
FIG. 6
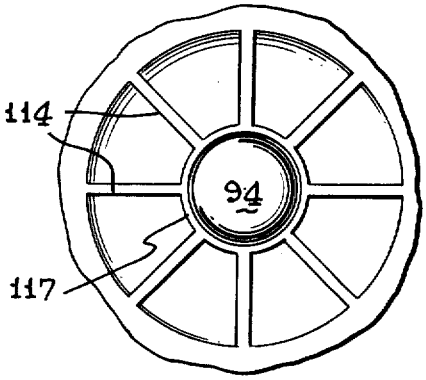
FIG. 8
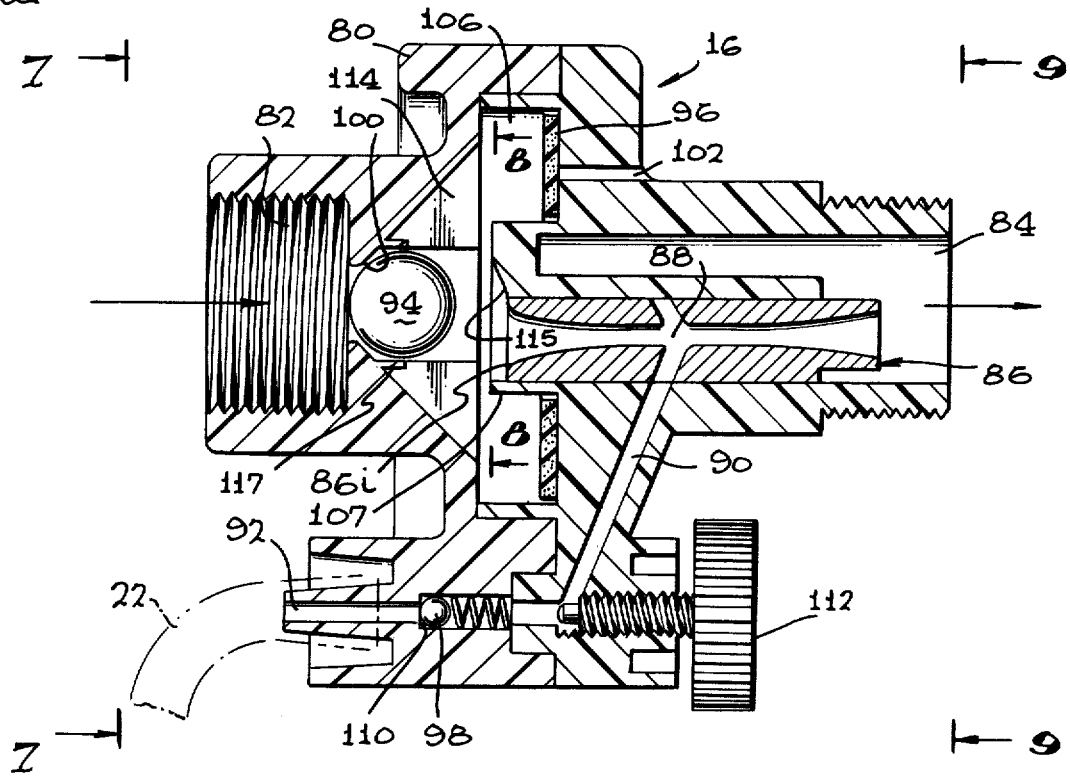
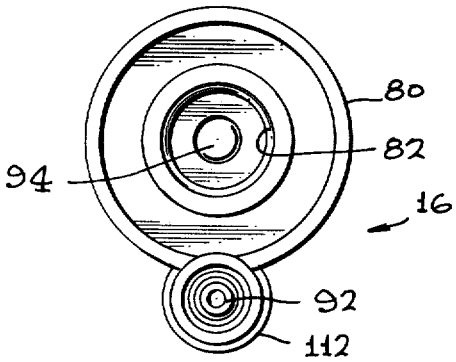
FIG. 7
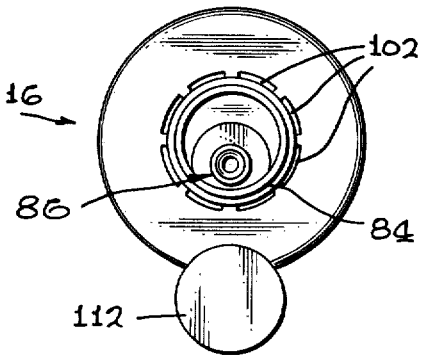
FIG. 9

FIG. 10
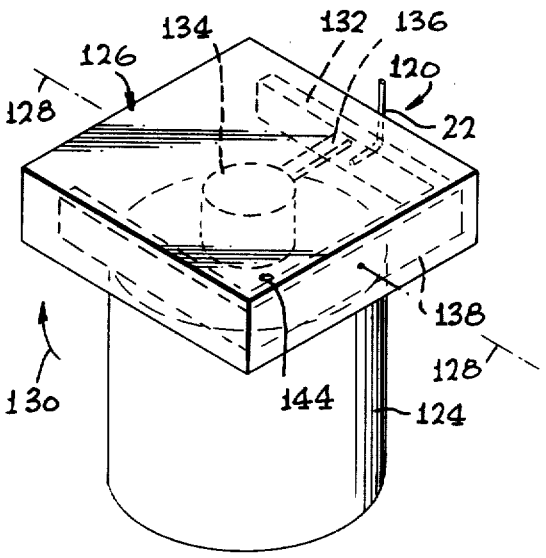
FIG. 11
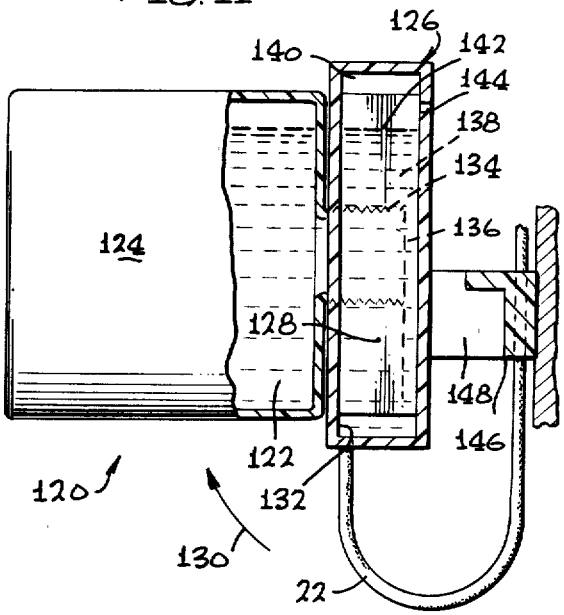
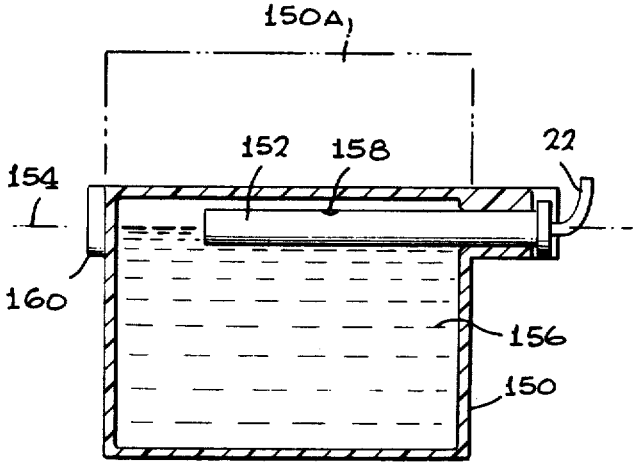
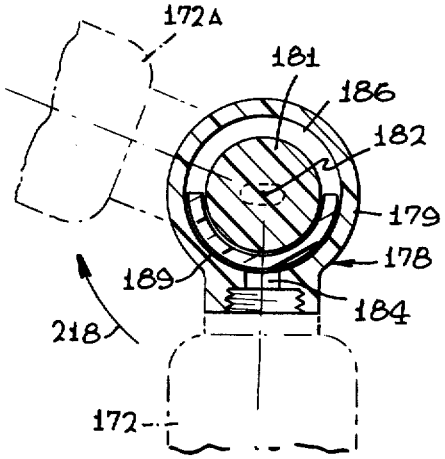
FIG. 15
FIG. 12
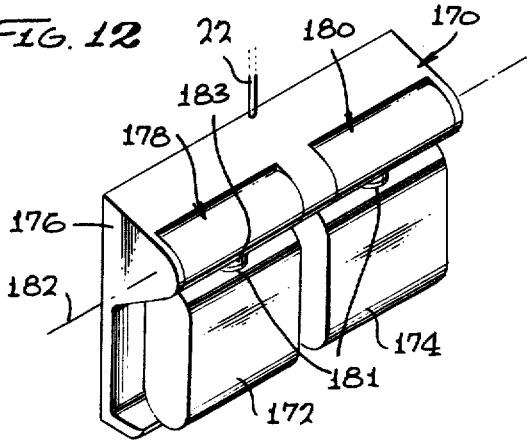
FIG. 13

SHOWER DISPENSER

BACKGROUND OF THE INVENTION

The application of certain cosmetic or medicinal liquids to the entire body or a major portion thereof, can be facilitated by mixing them with shower water. A convenient procedure is to mix the additive or bathing liquid into the shower water only at a particular time such as the end of the shower, and to then mix only a small predetermined amount of the liquid, to avoid wasteage.

In order to enhance the convenience of the dispensing apparatus, it is desirable that a minimum of maintenance be required by the user, in measuring out and refilling the dispensing reservoir. Also, in many situations it is desirable to enable the user to select which of a plurality of different bathing liquids to apply. It is also desirable to construct the coupling apparatus which mixes the shower water with the bathing liquid, so that it operates with safeguards against the retention of stale water between shower usages, the backflow of water into the home shower system, and the backflow of shower water into the bathing liquid container and dispensing apparatus. All of this is preferably accomplished in a system of simple design to enable its manufacture and installation at low cost and to assure reliable operation.

SUMMARY OF THE INVENTION

In accordance with one embodiment of the present invention, a shower dispenser is provided for the dispensing of bathing liquid through a shower head, which is of simple, reliable, and convenient design. The system includes a reservoir assembly for holding a bathing liquid to be dispensed, and a mixer coupling for connecting a shower water supply to a shower head and for mixing water with the bathing liquid. The reservoir assembly includes a housing forming a reservoir that holds a small quantity of bathing liquid, and a container that is detachably connected to the housing and which holds more than the reservoir to repeatedly fill it. The container is pivotally mounted to enable tipping so fluid flows out therefrom into the reservoir to fill it, the container then returning to its original position wherein no further fluid can flow from the container to the reservoir.

The mixer coupling which connects the wall water outlet to the shower head and to a tube extending to the bathing liquid reservoir, is of the type that includes a venturi having a throat portion that draws in the bathing liquid as shower water passes through. The coupling frame forms a chamber between the venturi inlet and the shower water supply, with at least one air vent connected to the chamber. A diaphragm movable in the chamber is pressed thereagainst when pressured water flows from the wall outlet towards the shower head. When the shower is turned off, the diaphragm moves away from the air vents, to allow air to enter the chamber and permit the drainage of water lying in the coupling and shower head. A check valve between the chamber and the wall outlet, includes a ball that moves into the chamber when water passes out of the wall outlet to the shower head, the ball then deflecting water against the diaphragm to assure that it is tightly closed against the air vents.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a shower dispenser system constructed in accordance with the present invention.

FIG. 2 is a partial sectional front view of the dispenser system of FIG. 1, showing the reservoir assembly thereof, and with one of the containers in a tipped position.

FIG. 3 is a partial exploded perspective view of the reservoir assembly of FIG. 2.

FIG. 4 is a view taken on the line 4—4 of FIG. 2.

FIG. 5 is a perspective view of the mixer coupling of the system of FIG. 1.

FIG. 6 is a sectional view of the coupling of FIG. 5.

FIG. 7 is a view taken on the line 7—7 of FIG. 6.

FIG. 8 is a view taken on the line 8—8 of FIG. 6.

FIG. 9 is a view taken on the line 9—9 of FIG. 6.

FIG. 10 is a partial perspective view of a reservoir assembly constructed in accordance with another embodiment of the invention.

FIG. 11 is a sectional side view of the reservoir assembly of FIG. 10, shown in a tipped position.

FIG. 12 is a partial sectional view of a reservoir assembly constructed in accordance with another embodiment of the invention.

FIG. 13 is a perspective view of a reservoir assembly constructed in accordance with another embodiment of the invention.

FIG. 15 is a view taken on the line 15—15 of FIG. 14.

FIG. 7 is a side elevation view of a portion of the assembly of FIG. 14.

DESCRIPTION OF THE PREFERRED EMBODIMENTS

Figure 14:
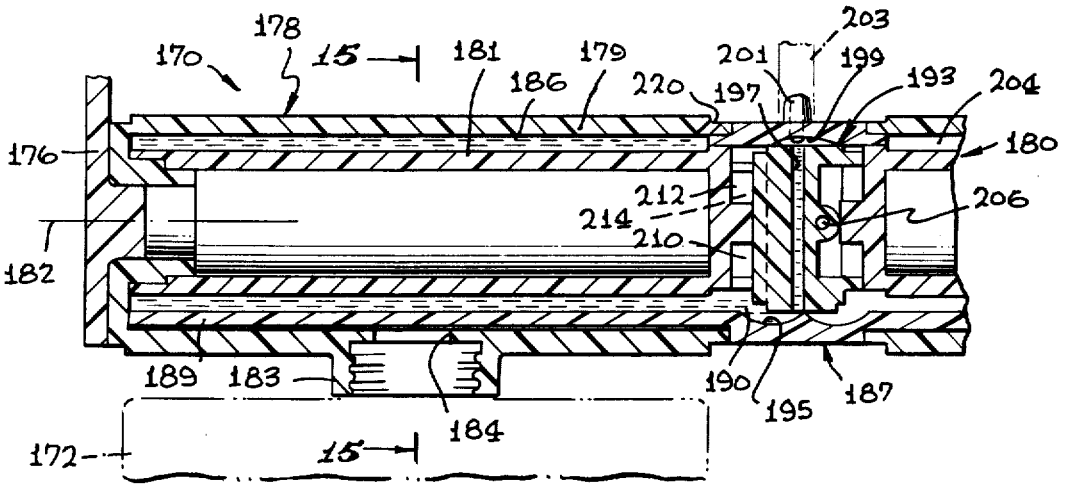
FIG. 14 is a partial section view of the reservoir assembly of FIG. 13.

FIG. 1 illustrates a shower dispenser system 10 which includes a reservoir assembly 14 for holding a bathing liquid, a mixing coupling 16 for connection between a shower water supply outlet 18 and a shower head 20, and a conduit or tube 22 for carrying the bathing liquid from the reservoir assembly to the coupling. The reservoir assembly 14 includes a housing 24 that can be mounted on a wall 26 beneath the shower water outlet 18 that also extends from the wall. The coupling 16 is designed to be readily connected in series with the outlet 18 and a typical shower head 20. The system can be utilized by persons who wish to spray themselves with a cosmetic lotion such as perfumed oil, or a medicinal liquid, by mixing it with shower water near the end of a shower.

The reservoir apparatus 14 includes a reservoir 30 which can hold a small amount of the bathing liquid which is to be dispensed at a single time, such as a fraction of an ounce. Prior to filling of the reservoir 30, the liquid is stored in one of two disposable bottles 32, 34. Each bottle holds a different liquid, and the mechanism is constructed to enable the user to choose which of the liquids is to be dispensed. Each of the bottles such as 32 is of largely oval or elliptical shape, and is pivotally mounted about an axis 36 on a side of the centerline 52 nearest a foci of the ellipse, to enable pivoting as to the position 32A. Such pivoting causes filling of the reservoir 30 which will be immediately followed by the dispensing of the liquid from the reservoir. As shown in FIG. 2, each of the bottles, such as 32, has a base end 40 with a recess 42 that receives a housing projection 44. The upper or capping end 46 of the bottle has a spout 48 which is received in a tube 50 formed in the housing. Both the housing projection 44 and tube 50 are aligned along the axis of pivoting 36.

The axis of pivoting 36 of each of the bottles such as 32 on the housing, is located above the center line 52 of the bottle when the bottle hangs down to the position in which it is biased by gravity. In this normal downward position, an opening 54 in the spout lies along the top of the spout. Even when the bottle is full, the fluid therein only lies at about the level of the axis 36 (when the bottle hangs in its normal position), so that the opening 54 in the spout lies above the level of fluid, and fluid does not flow out of the bottle. When the bottle is pivoted up, as to the position 34A shown for the bottle 34 in FIG. 4, the opening 54A in that bottle becomes aligned with an opening 56 in the spout-receiving tube 58. At the same time the pivoting up of the bottle to 34A, raises the level of the bathing liquid 60 in the bottle to the height 62 which is above the level of the spout opening 54. Accordingly, bathing liquid 60 in the bottle pours out of the bottle at 34A into the reservoir 30 to fill it.

Bathing liquid flows out of the pivoted bottle 34A, until the liquid in the reservoir reaches approximately the height of the pivot axis 36, when the liquid covers the spout opening 54A to prevent the bubbling in of air so that no further liquid can flow out of the bottle into the reservoir. The walls of the reservoir 30 are transparent, so that the user can see that the reservoir is filled, so he knows he can then release the bottle to let it hang down. The spout opening can be easily made large enough to fill a reservoir which holds perhaps one-third ounce of bathing liquid, in about one second. Gradations can be placed on the reservoir, to enable partial filling by a person, who tips the bottle very gradually to cause a slower rate of filling. Each bottle such as 34 holds much more bathing fluid than the reservoir, such as perhaps eight ounces per bottle. As a bottle becomes depleted, the user will have to pivot it upward by a higher angle to raise the liquid level above the spout opening 54.

Once the reservoir 30 (FIG. 2) is filled with the bathing liquid, the liquid can immediately begin to flow through the conduit 22 to the mixer coupling 16. The conduit has a lower end 70 lying at the bottom of the reservoir, to eventually carry away all of the liquid from the reservoir. The reservoir has a vent opening 72 (FIG. 1) to facilitate the withdrawal of the liquid through the conduit.

As mentioned above, the reservoir apparatus 14 is constructed to enable filling of the reservoir from either of the two bottles 32 or 34. One precaution that must be taken, is to prevent the flow of bath oil dispensed from one bottle such as 34 through the reservoir into the other bottle 32, especially when one of the bottles such as 32 is almost empty. Such a flow is prevented by the fact that fluid in the reservoir 30 can rise only to the level of the spout opening 54A in the bottle 34A, when the bottle is pivoted to the position 34A. Such pivoting, which is necessary to cause the dispensing of bathing liquid from the bottle 34A, lowers the spout opening 54A of the bottle 34A from a position at the top of the spout as shown for the bottle 32 in FIG. 2, to the lowered position as shown for the bottle 34A where the spout opening lies on the axis 36. Since the fluid in the reservoir 30 cannot rise above approximately the level of the axis 36, such fluid cannot rise high enough to enter the spout opening of the other bottle 32. Thus, two bottles 32 and 34 which are substantially identical and interchangeable can be mounted on the apparatus so as to fill the same reservoir 30, without causing the flowthrough of fluid from one bottle to the other.

Each of the bottles can be removed by bending back a flap 76 (FIG. 2) on the housing 24, to withdraw the projection 44. The spout of the bottle then can be withdrawn from a corresponding tube 50 or 58, and another bottle installed to replace it. Even if one bottle is utilized every day, the only daily effort on the part of the user is the tipping of the bottle for about one second to fill the reservoir prior to dispensing of liquid. The user has to replace the bottle perhaps only every few weeks, and the replacement is easily accomplished, as by removing a cap (not shown) lying over the bottle spout, and then installing the bottle as described above. Accordingly, the occasional replacement, as well as the daily use of the apparatus, is very convenient.

FIGS. 5-8 show details of the mixer coupling 16 which is utilized to mix a bathing liquid received through the tube 22 from the reservoir, with shower water passing into the shower head 20. As shown in FIG. 6, the coupling includes a frame or housing 80 with a shower water inlet 82 for connection to a water supply, a shower outlet 84 for connection to the shower head, and a venturi device 86 which has a throat 88 that produces a vacuum when water passes through the venturi. The throat 88 is coupled through a passageway 90 in the housing to an inlet 92 that receives bathing liquid from the tube 22. Although the coupling would function without any valves or the like therein, some means are desirable to prevent harm to the reservoir apparatus, the plumbing system of the building, and the coupling itself. Accordingly, the coupling 16 is provided with three valves, which include a ball valve member 94 that prevents the backflow of water into the plumbing system of a house, a vent valve member or diaphragm 96 that permits the drainage of water out of the coupling when the shower is not used, and a reservoir-protecting valve member 98 that prevents the flow of shower water down into the reservoir.

The anti-backflow valve member 94 is a ball that can move against and away from a seat 100. When the typical shower control valve (not shown) is turned on to allow water to issue from the wall supply, the ball 94 moves away from the seat 100 to allow water to pass through the coupling to the shower head. However, if a long hose is connected to the coupling outlet 84 and such a hose is raised to a high level above the ground, it is possible for water to be forced in a backward direction through the coupling and into the water supply of the house, to contaminate it. Such a backflow is stopped by the anti-backflow valve member 94.

When the user turns off the shower, some water (which may be mixed with a bathing liquid) may lie in the coupling 16. It is usually desirable to avoid the trapping of such water, since it can lead to mildew and other undesirable effects. To avoid such trapping, vents 102 are formed in the housing, which lead to a chamber 106 that lies between the anti-backflow valve seat 100 and the venturi inlet 86*i*. When the shower water supply is turned on, so there is pressured water in the chamber 106, the pressure of the water presses the diaphragm 96 against the chamber wall which forms the vents 102, to close these vents so that water cannot flow out therethrough. However, when the water supply if turned off, so there is no pressured water in the chamber 106, the diaphragm 96 can move away from the vents 102 to uncover them, so that air can flow into the chamber 106. Such venting air pemits the drainage of water lying in the chamber 106 and elsewhere in the coupling, so that the water can flow out through the outlet 84 and through the shower head or any other apparatus connected thereto. The diaphragm 96 is of annular shape and surrounds a tube 107 that guides the diaphragm in its movement.

One problem that must be avoided is the flow of shower water down through the coupling 22 into the reservoir. Such a flow could occur if the shower head 20 or any other device connected to the coupling outlet 84 blocks it, so that the pressured water in the venturi 86 can not flow rapidly therethrough. To prevent such backward flow of water through the reservoir, the check valve ball 98 is provided which can move against a valve seat 110 to prevent backward flow of liquid. It may be noted that a control valve member 112 is also provided, which can control the resistance to flow through the passage 90, to enable control of the rate through which the bathing liquid is removed from the reservoir and mixed into shower water. The passage 90 can be constructed to normally dispense all of the liquid in the reservoir in a period such as one half minute, but the valve 112 can be turned in to slow the dispensing.

Referring again to the anti-backflow valve member 94, it may be seen that this ball 94 is confined by several fins 114 (FIG. 8) to control movement of the ball. To prevent the ball from blocking the venturi inlet 86*i* (FIG. 6), the venturi inlet is located off center from the axis of movement of the ball 96, so that the walls surrounding the venturi inlet block further forward movement of the ball. When the ball 96 moves against a wall 115 adjacent to the venturi inlet 86*i*, the ball is positioned so that it deflects water entering the chamber 106 against the diaphragm 96, so that the velocity of the incoming water adds to the pressure of the water in pressing the membrane 96 firmly against the housing wall that forms the vents 102. This assures deformation of the rubber diaphragm or washer 96 so that it provides a good seal against the walls forming the vents 102 to prevent the unwanted leakage of water therethrough.

When the ball 94 moves firmly against the seat 100, the backflow of water is prevented. However, if a small amount of debris becomes trapped between the ball and seat 100, backward water leakage could occur. To prevent this, a short cylinder 117 closely surrounds the ball 94 even when the ball lifts off the seat by a small distance such as one-sixteenth inch, to prevent rapid backward water flow around the ball.

FIGS. 13–15 illustrate a reservoir apparatus 170 which utilizes containers or bottles 172, 174 for holding bathing liquid, which are of relatively symmetric and attractive appearance, and with the reservoir apparatus being of relatively simple construction. The apparatus includes a housing 176 which pivotally supports each of a pair of dispensing holders 178, 180. Each holder 178, 180 has a container coupling 183 with a hole, which can be threadably attached to the neck 181 of a corresponding bottle and can pivot about a horizontal axis 182 on the housing. (The threads are of the interrupted or bayonet type, but can be continuous). When a bottle such as 172 is pivoted up, as to the position 172A (FIG. 15), bathing liquid in the bottle is dispensed through an aperture 184 in the holder 178, and into a reservoir 186 to fill it.

As shown in FIG. 14, the reservoir 186 is formed by a space between an outer dispensing holder member 179 and an inner member 181 which rotates together. A housing member 187 has an end portion 189 that lies within the lower half of the space between members 179 and 181. As soon as bathing liquid is dispensed into the reservoir 186, the liquid can begin flowing out through a passage 190 lying between the housing member 187 and a rotatable valve member 193, and into a recess 195 in the housing member. The liquid can then flow upwardly through a hole 197 that is shown extending vertically through the valve member, to a collection space or region 199. The fluid flows from the collection space 199 through a tube coupling 201, and then upwardly through a tube 203 to the shower head and the shower head coupling 16 described earlier herein. In a typical operation, the raising of the bottle to the position 172A (FIG. 15) need be performed for only about a second or two to completely fill the reservoir 186 which holds perhaps one third ounce of bathing liquid. With the shower operating so that liquid in the reservoir 186 is drawn up through the tube 203, it may require perhaps 30 seconds to dispense all of the bathing liquid. Accordingly, it does not matter whether the user holds the container in its upwardly pivoted position for a few extra seconds.

Figure 16:
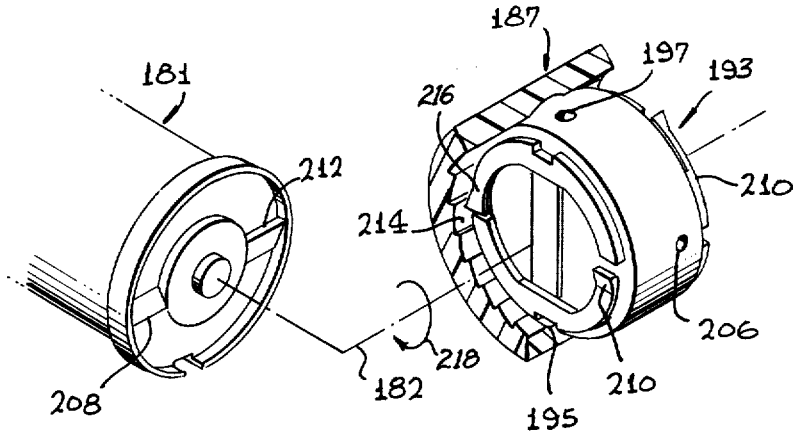
FIG. 16 is a partial perspective and exploded view of the assembly of FIG. 14.
Figure 17:
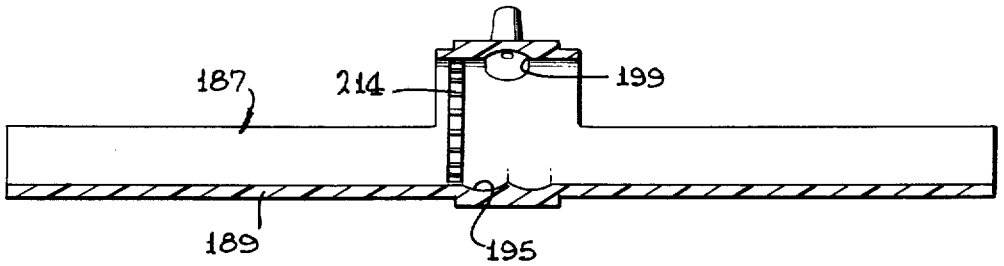

It is desirable to prevent the flow of bathing liquid from one reservoir 186 into a second reservoir 204 of the reservoir apparatus. To prevent such a flow, the rotatable valve member 193 is provided with a second hole 206 that extends perpendicular to the first one 197, so that only one valve hole at a time connects to the collection space 199. When the left bottle 172 is raised up by over 90° and then lowered, the valve member 193 is automatically rotated to the position shown in FIG. 14 wherein its hole 197 is vertical. This is because a tooth such as 208 (FIG. 16) on the inner holder member 181 will engage a pawl 210 on the valve member when the holder member 181 again pivots to lower the bottle that has been raised, to rotate the valve member in the direction of arrow 218 to the desired position. If the valve member is already in position, neither tooth 208 nor 212 will engage the pawl. Ratchet teeth 214 on the housing member 187 and a deflectable arm 216 on the valve member, prevent rotation of the valve member in a direction opposite to arrow 218. The second holder 180 has a ratcheting mechanism that can rotate the valve member by 90° when the second bottle 174 is raised and lowered to fill the second reservoir 180, to move the second valve member hole 206 to a vertical position.

The housing member 187 encourages a complete (over 90°) raising of the bottle 172, because its end portion 189 forms a vane-like blocking member which prevent the rapid dispensing of bathing liquid from the bottle 172 until the bottle is raised to more than about 90° from the downward position, as to position 172A (FIG. 15). In order to enhance the appearance of the apparatus, the dispensing holder 178 is formed of light-transmitting material, which may be translucent or transparent, so that colored bathing liquid can be seen to enter into the reservoir 186. As a result, when the apparatus is filled with a colored bathing liquid, the entire largely cylindrical region within the hollow dispensing holder 178 (between the axial ends of reservoir 186) displays the color of the liquid. An air hole 220 is provided at the top of the reservoir, which enables the outflow of fluid through the passge 190. The air hole also permits the apparatus to function as an aerator when all of the bathing liquid in the reservoir has been withdrawn, by permitting air flow to the throat of the shower coupling venturi at 88 (FIG. 6) where air is rapidly drawn into mix with the water.

The bottles 172, 174 can be sold with removable caps threaded onto their necks at 181. The bottle is installed by removing the cap, pivoting up the dispensing holder such as 178, and screwing the bottle into a threaded aperture 208 on the dispensing holder.

FIGS. 10 and 11 illustrate a reservoir apparatus 120 of simple construction, which enables the dispensing of a bathing liquid 122 from a single container 124, utilizing a simple tipping action of the container to fill a small reservoir. The apparatus includes a housing 126 which is pivotally mounted about an axis 128, to enable pivoting from the positions shown in FIG. 10, in the direction of arrow 130 to the position shown in FIG. 11. The housing 126 forms a reservoir 132 which can hold a small predetermined amount of the bathing liquid. The container 124 is fastened to the housing 126 so that it pivots with the housing. When the container and housing are pivoted to the position shown in FIG. 11, bathing liquid flows out of a spout 134 in the bottle, and through a narrow passage 136, and downwardly therealong to the reservoir 132 to fill it. When the reservoir 132 is filled, a small additional amount of bathing liquid can flow into the reservoir to fill a narrow connecting passage 138 that leads to an upper chamber 140. The bathing liquid rises only as high as the level 142 of liquid in the tilted bottle. Air in the reservoir passages escapes through a vent 144.

After the reservoir 132 and the narrow connecting passage 138 are filled, the bottle 124 can be lowered again to the position shown in FIG. 10. The liquid in the reservoir 132 then falls slightly, as the liquid is distributed so that it partially fills the upper chamber 140 (which has been lowered) as well as partially filling the reservoir 132. This prevents the liquid from flowing back through the passage 136 into the container. The bathing liquid in the reservoir 132 and the upper chamber 140 (as well as in the narrow passage 138) is then dispensed through the tube 22 that leads to the mixer coupling 16 of FIG. 5. A simple bracket 146 is utilized to pivotally mount the housing 126 on a wall, the bracket having a pair of arms 148 that pivotally support opposite sides of the housing. This apparatus is simple in construction, and yet still permits a user to operate it by loading a container or bottle 124 only once in a while, and enables the user to fill the reservoir by merely tilting up the bottle and then allowing it to pivot down again. It may be noted that as the bottle 124 becomes empty, the user can still dispense almost all of the liquid by merely tilting the bottle somewhat higher.

The utilization of a replaceable bottle that can be pivoted up to fill a reservoir of predetermined volume much smaller than the volume of the bottle, can be incorporated in a variety of different embodiments. FIG. 12 illustrates a container 150 which is pivotally mounted on a tube 152 which also serves as the reservoir. When the container 150 is pivoted up about the axis 154 of the tube, to the position 150A, the level of the liquid 156 rises, so that it can flow through a hole 158 in the tube to fill it. The tube 152 is of a length and inside diameter that provides the desired amount of reservoir volume to hold the amount of bathing liquid to be dispensed through the tube 22. When the container is allowed to pivot down to the position shown at 150, the level of the liquid falls below the opening 158 in the tube. A housing 160 can be provided to support the tube 152 and hold the base end of the bottle. It is also possible to form a reservoir within the bottle itself, which is refilled every time the bottle is tilted.

Thus, the invention provides a shower dispenser of relatively simple design and which can be easily utilized to dispense a controlled amount of liquid into the shower stream, at a desired time such as near the end of a shower, which requires a minimum of operator involvement. By utilizing a replaceable container to hold a volume of bathing liquid much larger than the volume of the reservoir, and by mounting the container so it can be pivoted to fill the reservoir, the user need only tilt and release the container at each use, and need merely replace the container bottle at long intervals. The mixer coupling which connects a shower head to a shower water supply that extends from a wall of the like, can be constructed with a group of valves that assures proper operation of the system. The valves can include a breaker or venting valve of simple construction to permit the drainage of water from the coupling, when the shower is turned off and can include an anti-backflow valve that aids in the proper sealing of vents in the coupling.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A shower dispenser for mixing a liquid into shower water that will flow through a shower head, comprising:

a reservoir assembly for holding a liquid to be dispensed;

a conduit connected to said reservoir assembly to carry liquid therefrom; and a mixer coupling for connecting a shower water supply and said conduit, to a shower head, to mix water from the outlet and liquid from the reservoir assembly;

said reservoir assembly including a housing forming first and second reservoirs which can each hold a small quantity of liquid to be mixed into the shower water, a pair of containers which are each detachably mounted to said housing and which can each hold more than one of said reservoirs to repeatedly fill it, said housing supporting each of said containers in pivotal movement to enable pivoting of the container in a predetermined direction about a pivot axis, and each reservoir and corresponding container having openings which are connected at least when the container pivots, whereby to fill the reservoir.

2. A shower dispenser for dispensing a bathing liquid that can be mixed with shower water to flow through a shower head, comprising:

a reservoir assembly (170) for holding a liquid to be dispensed, and having an outlet (190) for dispensing the liquid;

said reservoir assembly including a housing (176), and said reservoir assembly also including a dispensing holder (178) in the form of an elongated hollow member pivotally mounted about a horizontal axis on said housing and having a container coupling with a hole (184) for receiving the neck of a bottle, so that the holder and bottle can be tilted up to flow bathing liquid from the bottle into the hollow dispensing holder, said reservoir assembly including a housing member with a portion (189) which lies in said holder and which does not pivot with said dispensing holder, said housing member portion positioned to block the free inflow of fluid through said coupling hole until the dispensing holder is raised by more than a predetermined angle of about 90°.

3. A shower dispenser for mixing a liquid into shower water that will flow through a shower head, comprising:

a reservoir assembly for holding a liquid to be dispensed;

a conduit connected to said reservoir assembly to carry liquid therefrom; and a mixer coupling for connecting a shower water supply and said conduit, to a shower head, to mix water from the outlet and liquid from the reservoir assembly;

said reservoir assembly including a housing forming a reservoir which can hold a small quantity of liquid to be mixed into the shower water, a detachable container with upper and lower portions, which is detachably mounted at its upper portion to said housing and which can hold more than the reservoir to repeatedly fill it, said housing supporting said container in pivotal movement about a largely horizontal axis to enable pivoting of the container, in a direction to raise the lower portion of the container and said reservoir and container having openings which are connected at least when the container has been pivoted, to fill the reservoir.

4. The dispenser described in claim 3 wherein:

said housing including a stationary housing portion, and a largely cylindrical holder pivotally mounted about a horizontal axis passing along the axis of the cylindrical holder, said holder having an opening on one side for attachment to said container so the container normally hangs down from said holder but its bottom can be raised to pivot the holder.

5. A shower dispenser for mixing a liquid into shower water that will flow through a shower head, comprising:

a reservoir assembly for holding a liquid to be dispensed;

a conduit connected to said reservoir assembly to carry liquid therefrom; and a mixer coupling for connecting a shower water supply and said conduit, to a shower head, to mix water from the outlet and liquid from the reservoir assembly;

said reservoir assembly including a housing forming a reservoir which can hold a small quantity of liquid to be mixed into the shower water, and a detachable container which can hold more than the reservoir to repeatedly fill it and which has upper and lower container portions;

said detachable container having walls forming a single container opening at its upper portion through which it can be initially filled and out of which liquid can be dispensed, said housing having a housing opening and having detachable fastening means for holding said opening walls of said container in alignment with said housing opening, said housing pivotally supporting said container about a largely horizontal axis so the container can be pivoted to lift its lower portion to dispense liquid out of said container opening and through said housing opening into said reservoir, said housing having means for substantially preventing the flow of liquid back into said container when said container is lowered.

* * * * *